US007363843B2

(12) United States Patent
Chiu

(10) Patent No.: US 7,363,843 B2
(45) Date of Patent: Apr. 29, 2008

(54) SECURING DEVICE FOR SECURING BLADE OF CUTTING TOOLS

(75) Inventor: Cheng Hung Chiu, Taichung Hsien (TW)

(73) Assignee: Rexon Industrial Corp., Ltd., Tali, Taichung Hsien (TW)

( * ) Notice: Subject to any disclaimer, the term of this patent is extended or adjusted under 35 U.S.C. 154(b) by 0 days.

(21) Appl. No.: 11/295,658

(22) Filed: Dec. 7, 2005

(65) Prior Publication Data

US 2006/0123968 A1 Jun. 15, 2006

(30) Foreign Application Priority Data

Dec. 10, 2004 (TW) ..... 93219975 U

(51) Int. Cl.
*B26D 1/12* (2006.01)

(52) U.S. Cl. ..... 83/571; 83/666; 83/490

(58) Field of Classification Search ..... 83/581, 83/573, 664, 571, 666, 490; 411/544, 136, 411/542, 148, 150, 149
See application file for complete search history.

(56) References Cited

U.S. PATENT DOCUMENTS 2,709,470 A * 5/1955 Knohl ..... 411/134
2,931,087 A * 4/1960 Farrar et al. ..... 411/554
4,064,921 A * 12/1977 Kose ..... 411/148
4,205,572 A * 6/1980 Weiner ..... 83/666
4,779,382 A * 10/1988 Rudolf et al. ..... 451/342
5,090,126 A * 2/1992 Higgins ..... 30/388
5,545,078 A 8/1996 Schulz
6,171,039 B1 * 1/2001 Seurujarvi ..... 411/148
6,843,627 B2 1/2005 Childs et al.
7,013,987 B2 * 3/2006 Nock et al. ..... 83/666
2006/0096436 A1 5/2006 Phillips et al.
2006/0101975 A1 5/2006 Phillips et al.

* cited by examiner

*Primary Examiner*—Kenneth E. Peterson
*Assistant Examiner*—Sean Michalski
(74) *Attorney, Agent, or Firm*—Bacon & Thomas, PLLC

(57) ABSTRACT

A securing device for securing a blade of a cutting tool includes a clamp assembly, a bolt, a resistant slice and a driving member. The clamp assembly has two clamp members between which the blade is clamped. The bolt extends into the clamp assembly and is screwed into a driving shaft device of the cutting tool for securing and pressing the clamp assembly to clamp the blade. The resistant slice is shaped to a curvature. The bolt is through the resistant slice, and the head of the bolt presses the resistant slice so as to force the clamp assembly. The driving member includes a body fixed on the head of the bolt and a handle pivotally coupled to the body. The distance between the head of the bolt and a movable end of the handle is changed when the handle pivots with regard to the body.

17 Claims, 6 Drawing Sheets

SECURING DEVICE FOR SECURING BLADE OF CUTTING TOOLS

FIELD OF THE INVENTION

The present invention relates to a securing device which is easy to loosen a blade of a cutting tool without using assistant tools.

BACKGROUND OF THE INVENTION

A conventional securing device 10 of a cutting tool is shown in FIG. 6. The cutting tool generally includes a motor having a driving shaft device 11, the securing device 10, and a blade 15. The blade 15 rotates together with the driving shaft device 11 by the securing device 10 when the motor drives the driving shaft device 11. The securing device 10 clamps the blade 15 and is mounted to the driving shaft device 11. The securing device 10 substantially includes a bolt 16, a first clamp member 13 and second clamp member 14, and the blade 15 is clamped between the first and second clamp members 13, 14. The second clamp member 14 is mounted on the driving shaft device 11, and the bolt 16 extends through the first clamp member 13 and is screwed into the driving shaft 12 to force the first clamp member 13 moving toward the second clamp member 14 to securely clamp the blade 15 between the first and second clamp members 13, 14. When the blade 15 needs to be maintained or replaced with a new one, the user has to use a tool to unscrew the bolt 16 to let the first clamp member 13 be loosened from the blade 15. In other words, the blade 15 can only be removed from the securing device 10 by using a tool such as a wrench. Furthermore, the blade 15 could be damaged or deformed if the bolt 16 is screwed too tight.

The present invention intends to provide a securing device that can be loosened without using a tool. Instead, the securing device has a handle that the user can simply rotates to loosen the securing device.

SUMMARY OF THE INVENTION

The present invention relates to a securing device of a cutting tool wherein the cutting tool includes a motor having a driving shaft device and a blade. The securing device includes a clamp assembly having two clamping members. The clamp assembly is mounted on the driving shaft device, and the blade is clamped between the two clamp members. The securing device also includes a resistant slice and a pressing member whose first side is in contact with one of the clamp members. The resistant slice whose first side presses on a second side of the pressing member. The securing device further includes a bolt and a driving member. The bolt extends through the resistant slice, the pressing member and the blade and into the clamp assembly, and is screwed into the driving shaft device. The driving member includes a body and a handle. The body is fixed on a head of the bolt, and the handle is pivotally connected to an end of the body.

The torque, applied by a user for loosening the bolt can be increased because the distance between the head of the bolt and a movable end of the handle is changed when the handle pivots with regard to the body. Therefore, the user can loosen the bolt without using a assistant tool. Moreover, the resistant slice shaped to a curvature can protect the securing device from the too large torque applied by user.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
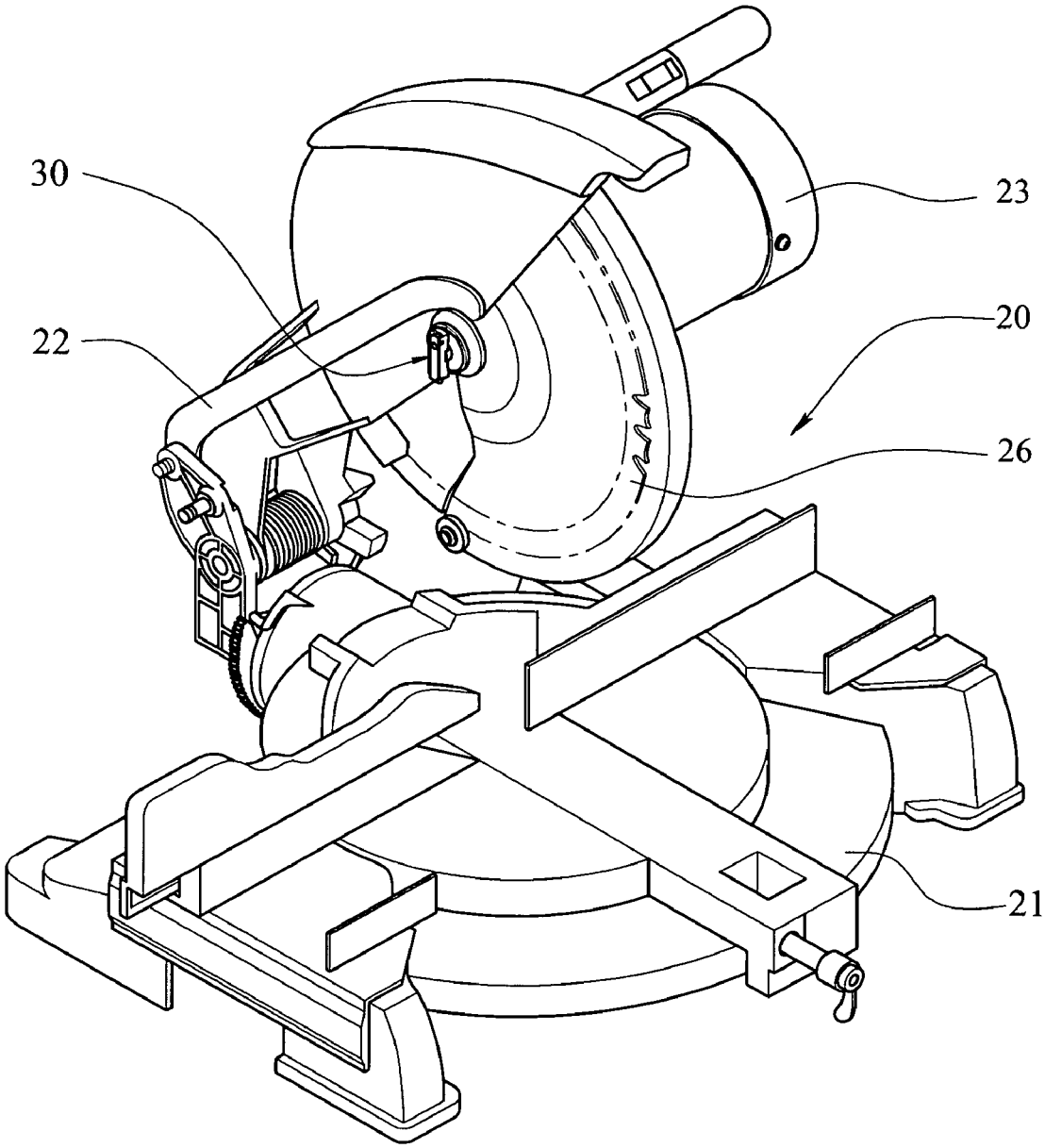
FIG. 1 is a perspective view to show a cutting tool with the securing device of the present invention.
Figure 2:
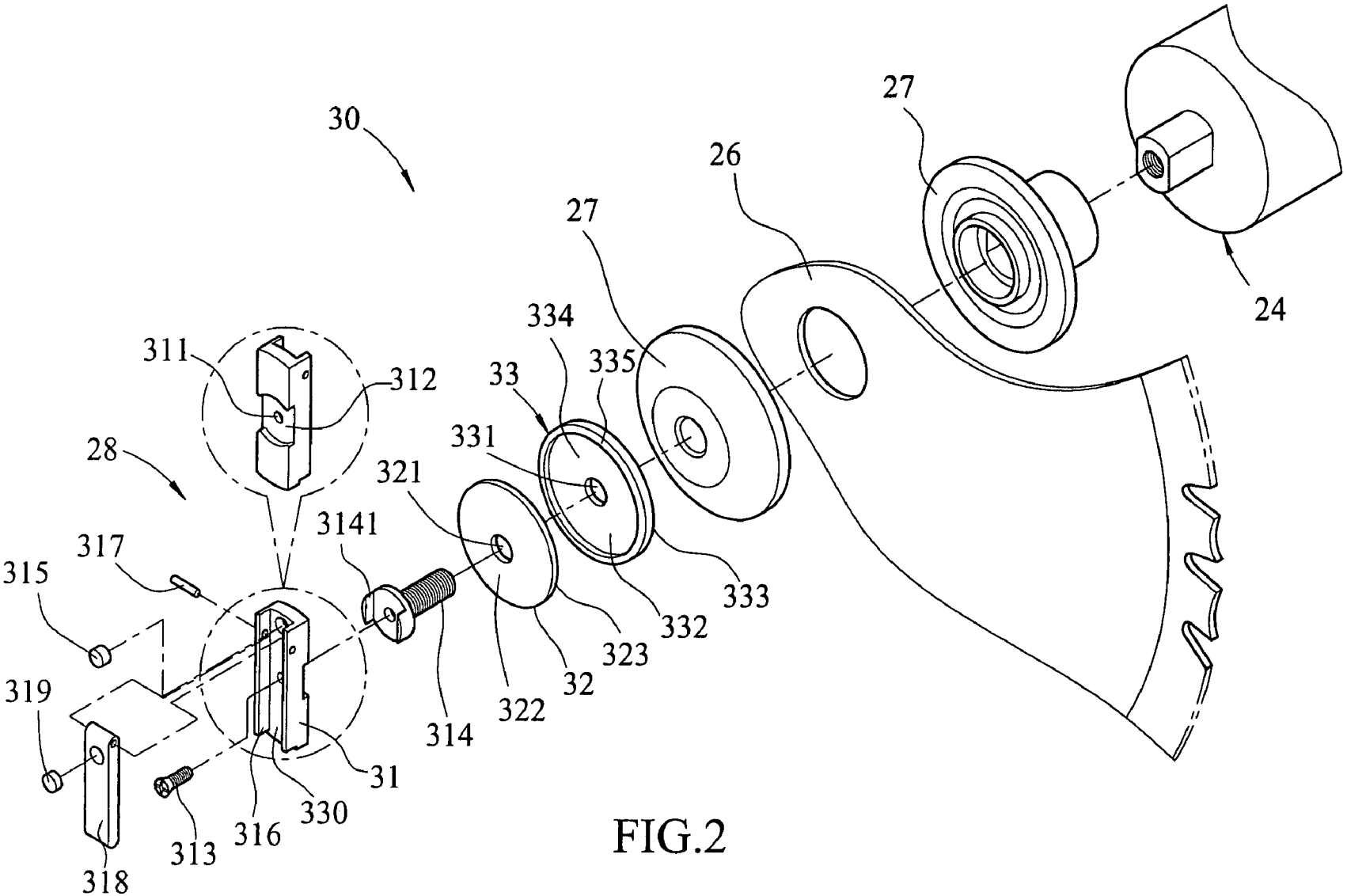
FIG. 2 is an exploded view to show the securing device of the present invention.
Figure 3:
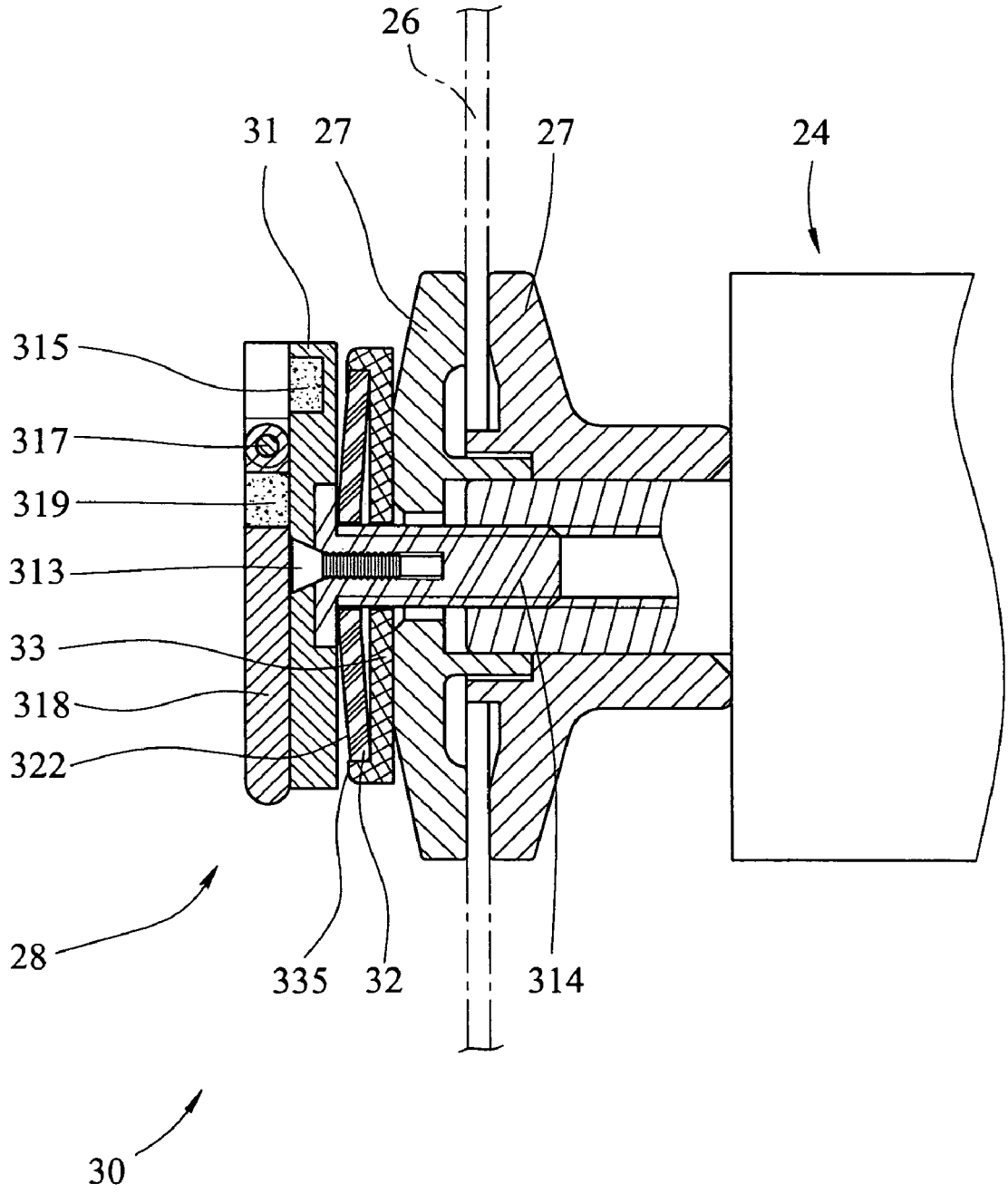
FIG. 3 is a side cross sectional view to show that the clamp assembly clamps the blade and the securing device urges the clamp assembly.

The present invention provides a securing device of a cutting tool. Referring to FIGS. 1 to 3, the cutting tool 20, for example a miter saw, includes a base 21, an arm 22 pivotally connected to the base 21, a motor 23 connected to the arm 22, a blade 26 and the securing device 30. The motor 23 has a driving shaft device 24. The blade 26 rotates together with the driving shaft device 24 by the securing device 30 when the motor 23 drives the driving shaft device 24. The securing device 30 clamps the blade 26 and is mounted on the driving shaft device 24. The function of the securing device 30 is to connect the blade 26 and the driving shaft device 24, so can be adapted to any kind of cutting tools having the blade and the Referring to FIGS. 2 to 3, the securing device 30 has a clamp assembly 27, a pressing member 33, a resistant slice 32, a bolt 314 and a driving member 28. The clamp assembly 27, similar to conventional structure, includes two clamping members 27 mounted on the driving shaft 24 and between which clamping the blade 26. The pressing member 33 has a basic board 334 and a skirt 335. The basic board 334 has an open first central hole 331 and has a first side 333 and a second side 322. The first side 333 is in contact with one of the clamp members 27. The skirt 335 extends from a periphery of a second side 332 of the basic board 334.

The resistant slice 32 is shaped according to the pressing member 33, for example as a disk. The resistant slice 32 has an open second central hole 321 and has a first side 323 and a second side 322. The cross section of the resistant slice 32 is curved. The first side 323 of the resistant slice 32 is shaped to a concave curvature. The periphery of the first side 323 presses on the second side 332 of the basic board 334 and is enclosed by the skirt 335. The dimension enclosed by the skirt 335 is greater than the dimension enclosed by the periphery of the first side 323 of the resistant slice 32. Moreover, the second side 322 of the resistant slice 32 is shaped to a convex curvature.

The bolt 314 extends through the second central hole 321 of resistant slice 32, the first central hole 331 of the pressing member 33 and the blade 26, extends into the clamp assembly 27, and is screwed into the driving shaft device 24. The head of the bolt 314 presses the second side 322 of the resistant slice 32 so as to force the clamp assembly 27 to clamp the blade 26 tightly. The head of the bolt 314 includes two wings 3141 extending axially and oppositely from the periphery of the head of the bolt 314.

The driving member 28 has a body 31, a handle 318 and a positioning bolt 313. The body 31 forms a recess 312 defined in a first side thereof. The head of the bolt 314 is engaged with the recess 312, and the body 31 is inserted between the two wings 3141. The positioning bolt 313 extends through a hole 311 opened in the body 31 and is screwed into the head of the bolt 314. By the means, the body 31 is secured on the head of the bolt 314 and simultaneously rotates the bolt 314 when being rotated. The body 31 also includes two flanges 316 and a pin 317. The two flanges 316 extend respectively along two sides of the bolt 314 and a groove 330 corresponding to a dimension of the handle 318 is formed between the two flanges 316. The pin 317 placed at a end of the body 31 extends through the two flanges 316 and a fixed end of a handle 318 so that the handle 318 is pivotally connected to the body 31. The handle 318 can be contained in the groove 330 or pivoted upward. The distance between the head of the bolt 314 and a movable end of the handle 318 is changed when the handle 318 pivots with regard to the body and is up to the longest as the handle 318 pivots about 180 degree.

The driving member 28 further provides a first magnet 319 and a second magnet 315. The first magnet 319 is embedded in the handle 318 and below the pin 317. The second magnet 315 is embedded in the body 31 of the driving member 31 and above the pin 317. The first magnet 319 and the second magnet 315 are substantially in alignment and repel each other when the handle 318 is pivoted about 180 degree from the body 31. The body is made of a magnetic-induction material, reverse to the handle 318. Therefore, the second magnet 315 attracts the body and enhances the connection of the handle 318 and the body 31 when the handle 318 is contained in the groove 330.

Figure 4:
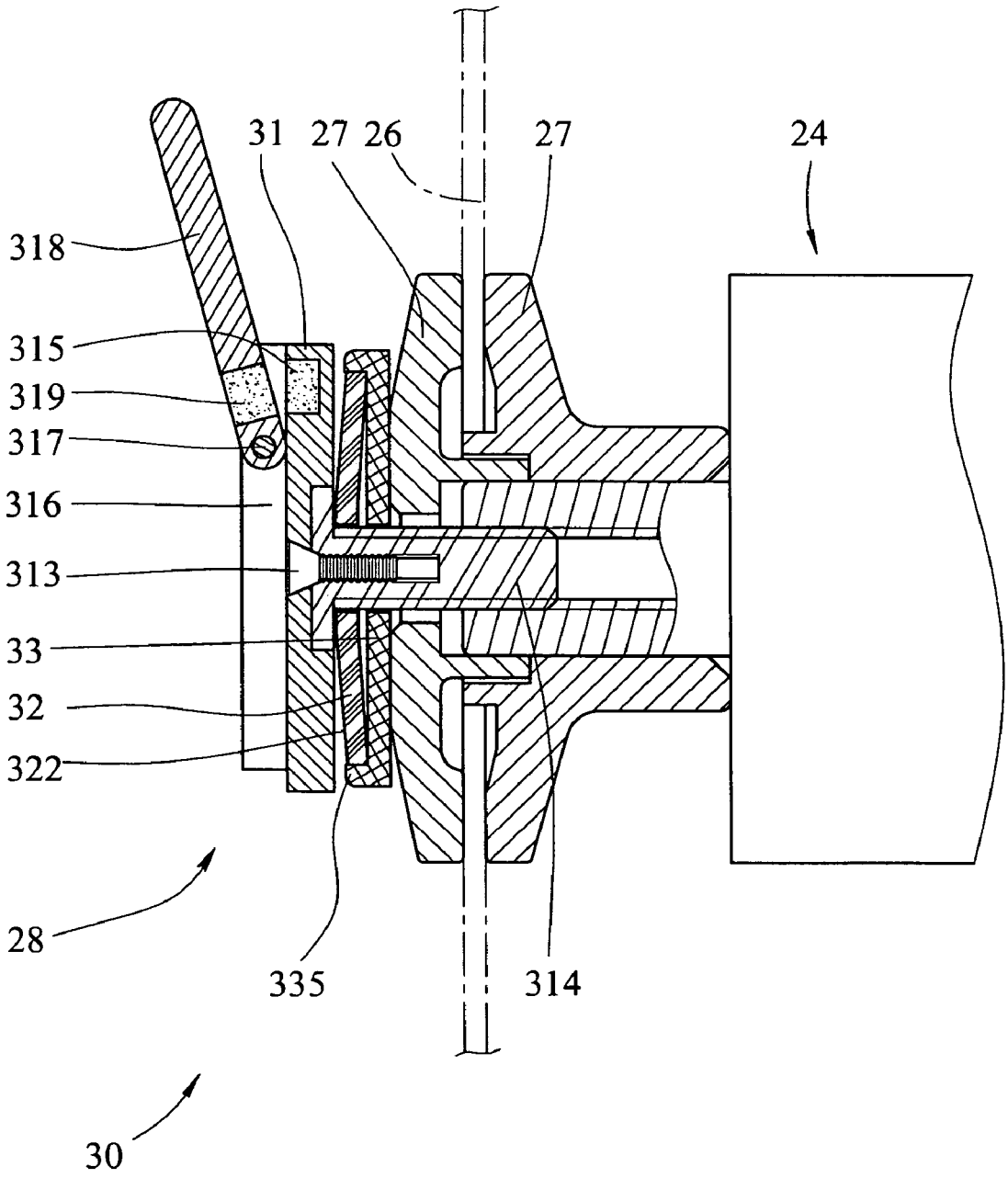
FIG. 4 shows that the handle of the driving member is pivoted upward to rotate the bolt.

As shown in FIGS. 4, when the blade 26 needs to be removed from the clamp assembly 27, the user pivots the handle 318 upward and applies a force to the handle 318 so as to rotate the body 31 and then loosen the bolt 314. Therefore, the user can proceed with the procedure for changing the blade 26 without using a assistant tool, such as a wrench.

Figure 5:
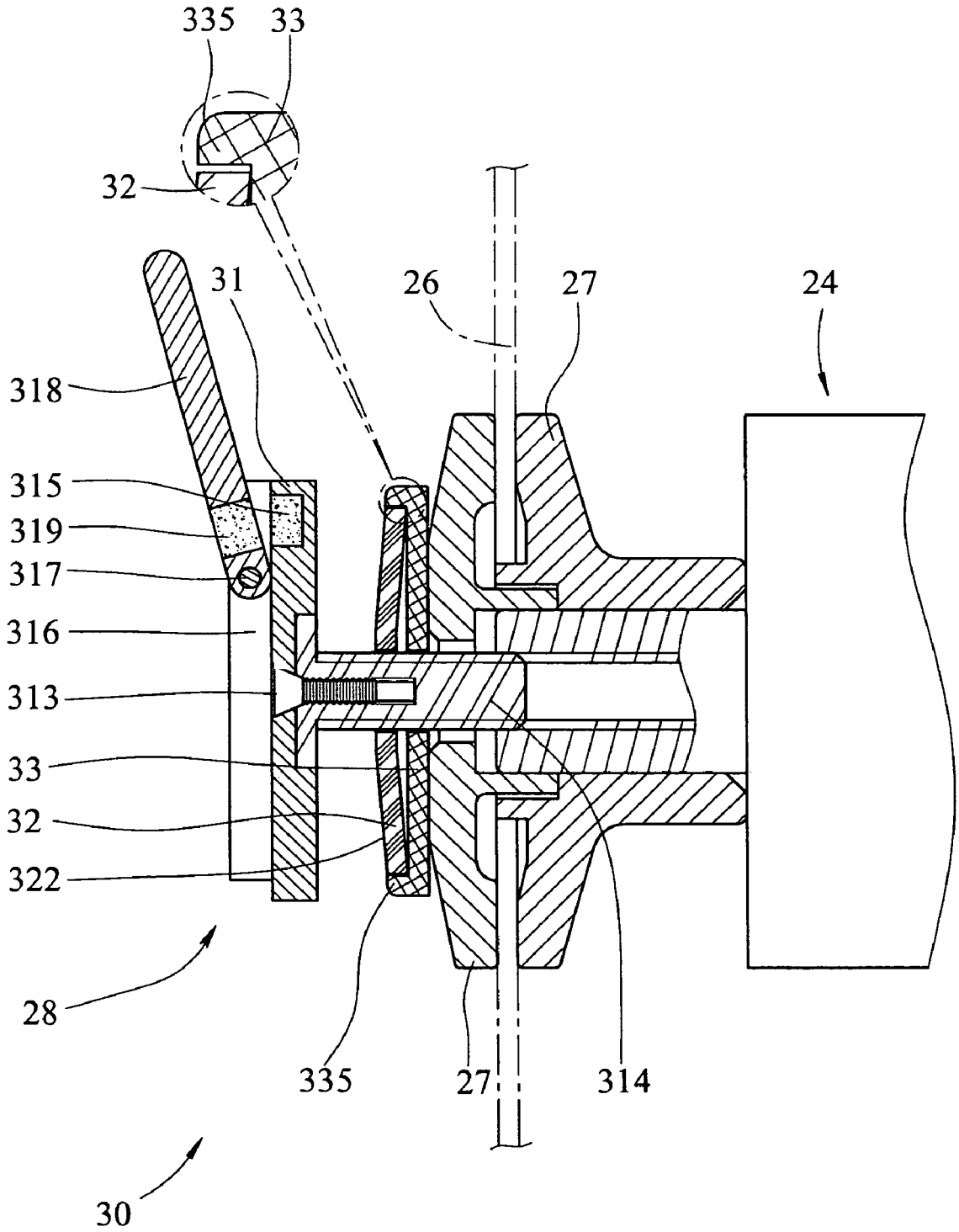
FIG. 5 shows that the bolt is loosened and the resistant slice does not press on the pressing member.
Figure 6:
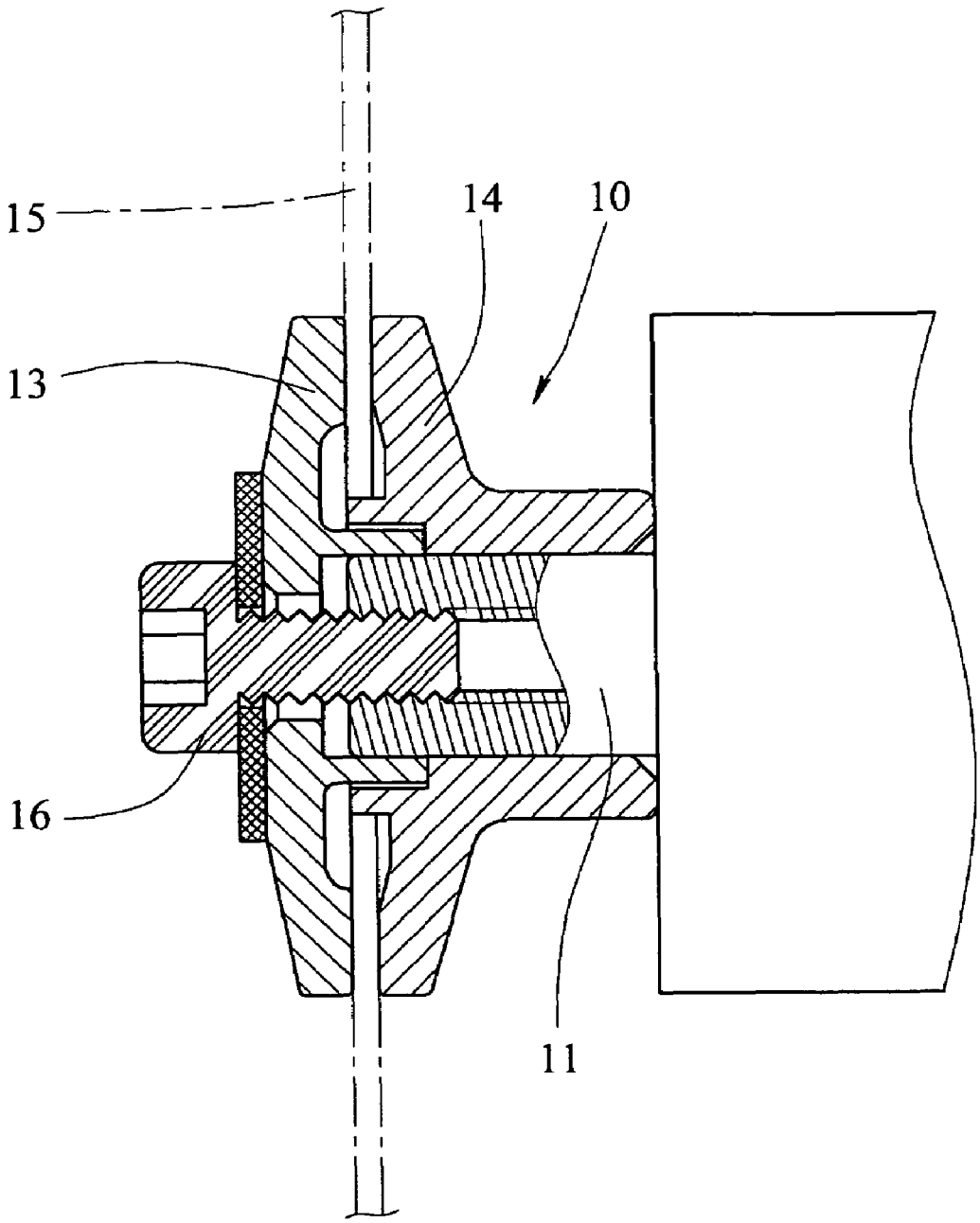
FIG.6 PRIOR ART
FIG. 6 is a cross sectional view to show a conventional securing device.

As shown in FIGS. 5, when the bolt 314 is loosened, a gap is formed between the skirt 335 and resistant slice 32. When the user force the handle 318 to screw the bolt 314 into the driving shaft device 24, the head of the bolt 314 presses the second side 322 of the resistant slice 32 so that the periphery of the first side 323 of the resistant slice 32 force the pressing member 33 to press the clamp assembly 27 to clamp the blade 26. When the bolt 314 is screwed too strongly, the resistant slice 32 is deformed slightly so as to resist the pressure from the head of the bolt 314. Therefore, the resistant slice 32 can protect the securing device 30 from the too large torque applied by user. After finishing the securing procedure of the blade 26, the handle 318 is automatically pivoted toward the body 31 because two respective same poles of the first magnet 319 and the second magnet 315 face with each other in the procedure.

While we have shown and described the embodiment in accordance with the present invention, it should be clear to those skilled in the art that further embodiments may be made without departing from the scope of the present invention.

What is claimed is:

1. A cutting tool having a securing device, the cutting tool including a blade and a motor including a driving shaft device, the securing device clamping the blade and mounted to the driving shaft device, the motor driving the driving shaft device to rotate the blade simultaneously with the securing device, the securing device comprising:

a clamp assembly mounted to the driving shaft device and including two clamping members between which the blade is clamped;

a bolt securing and pressing the clamp assembly to clamp the blade, the bolt extending into the clamp assembly and screwed into the driving shaft device; and a driving member configured for rotating the bolt, the driving member including a body fixed on a head of the bolt and a handle having a fixed end pivotally coupled to the body such that the distance between the head of the bolt and a movable end of the handle changes when the handle pivots with regard to the body;

a resistant slice having a first side shaped to a concave curvature and a second side shaped to a convex curvature, the bolt through the resistant slice, and the head of the bolt pressing the second side so that a periphery of the first side presses against the clamp assembly; and a pressing member having a basic board and a skirt extending from a periphery of the basic board, the bolt through the pressing member, the periphery of the first side of the resistant slice enclosed by the skirt and pressing the basic board.

2. The securing device as claimed in claim 1, wherein a dimension enclosed by the skirt is greater than a dimension enclosed by the periphery of the first side of the resistant slice.

3. The securing device as claimed in claim 1, wherein the head of the bolt includes two wings extending axially thereon, and the body of the driving member is inserted between the two wings.

4. The securing device as claimed in claim 1, wherein the driving member includes a positioning bolt extending through a hole opened in the body and screwed into the head of the bolt.

5. The securing device as claimed in claim 1, wherein the body forms a recess engaging with the head of the bolt.

6. The securing device as claimed in claim 1, wherein the body includes two flanges extending thereon and forming a groove corresponding to a dimension of the handle, and a pin extends through the two flanges and a fixed end of the handle.

7. The securing device as claimed in claim 1, wherein the driving member further includes a first magnet secured on the handle and a second magnet secured on the body, and the first magnet is substantially in alignment with the second magnet when the handle rotates about 180 degree from the body.

8. The securing device as claimed in claim 1, wherein the first magnet and the second magnet are repelling each other in alignment.

9. The securing device as claimed in claim 1, the cutting tool is a miter saw.

10. A cutting tool having a securing device, the cutting tool including a blade and a motor including a driving shaft device, the securing device clamping the blade and mounted to the driving shaft device, the motor driving the driving shaft device to rotate the blade simultaneously with the securing device, the securing device comprising:

a clamp assembly mounted to the driving shaft device and including two clamping members between which the blade is clamped;

a resistant slice having a first side shaped to a concave curvature and a second side shaped to a convex curvature; and a bolt securing and pressing the clamp assembly to clamp the blade, the bolt extending through the resistant slice and into the clamp assembly, and screwed into the driving shaft device, a head of the bolt pressing the second side of the resistant slice so that a periphery of the first side of the resistant slice pressing against the clamp assembly; and a pressing member having a basic board and a skirt extending from a periphery of the basic board, the bolt through the pressing member, the periphery of the first side of the resistant slice enclosed by the skirt and pressing the basic board.

11. The securing device as claimed in claim 10, wherein a dimension enclosed by the skirt is greater than a dimension enclosed by the periphery of the first side of the resistant slice.

12. The securing device as claimed in claim 10, further comprising: a driving member configured for rotating the bolt, the driving member including a body fixed on the head of the bolt and a handle having a fixed end pivotally coupled to the body such that the distance between the head of the bolt and a movable end of the handle changes when the handle pivots with regard to the body.

13. The securing device as claimed in claim 12, wherein the head of the bolt includes two wings extending axially thereon, and the body of the driving member is inserted between the two wings.

14. The securing device as claimed in claim 12, wherein the body forms a recess engaging with the head of the bolt.

15. The securing device as claimed in claim 12, wherein the body includes two flanges extending thereon and forming a groove corresponding to a dimension of the handle, and a pin extends through the two flanges and a fixed end of the handle.

16. The securing device as claimed in claim 12, wherein the driving member further includes a first magnet secured on the handle and a second magnet secured on the body, and the first magnet is substantially in alignment with the second magnet when the handle rotates about 180 degree from the body.

17. The securing device as claimed in claim 10, wherein the cutting tool is a miter saw.

* * * * *